United States Patent [19]

Larson et al.

[11] 4,307,275

[45] Dec. 22, 1981

[54] MEMBRANE SWITCH CONSTRUCTION AND METHOD FOR MAKING SAME

[75] Inventors: Willis A. Larson, Crystal Lake; Philip Bierhuizen, Harvard; Anthony Van Zeeland, Crystal Lake, all of Ill.

[73] Assignee: Oak Industries Inc., Rancho Bernardo, Calif.

[21] Appl. No.: 160,651

[22] Filed: Jun. 18, 1980

[51] Int. Cl.[3] ..... H01H 9/00; H01H 13/02

[52] U.S. Cl. ..... 200/159 B; 200/5 A; 200/292; 29/622

[58] Field of Search ..... 200/159 B, 5 A, 292; 29/622

[56] References Cited

U.S. PATENT DOCUMENTS

| | | | |
|---|---|---|---|
| 3,594,684 | 7/1971 | Miller | 200/159 B |
| 4,028,509 | 7/1977 | Zurcher | 200/159 B |
| 4,143,253 | 3/1979 | Wagner et al. | 200/292 |

*Primary Examiner*—Willis Little

*Attorney, Agent, or Firm*—Kinzer, Plyer, Dorn & McEachran

[57] ABSTRACT

A membrane switch construction and method for making same. A plate of relatively rigid, flat material is coated with an insulative cover and electrical conductors are formed thereon. A membrane of flexible, plastic material with conductors formed on the underside thereof overlies the plate. A non-conductive spacing means interposed between the conductors has holes in register with the conductors. The spacing means normally holds the conductors in spaced, non-contacting relation. The conductors are movable through the holes in the spacing means in response to pressure on the exterior of the membrane. One or the other or both of the sets of conductors may comprise two tiers of conductors separated by an isolation layer of non-conductive material. Holes are appropriately positioned in the isolation layer to permit access to the buried tier of conductors. Interconnect holes may also be provided in the spacing means to permit electrical connection between the conductors, thus forming a multi-layer conductive system.

29 Claims, 5 Drawing Figures

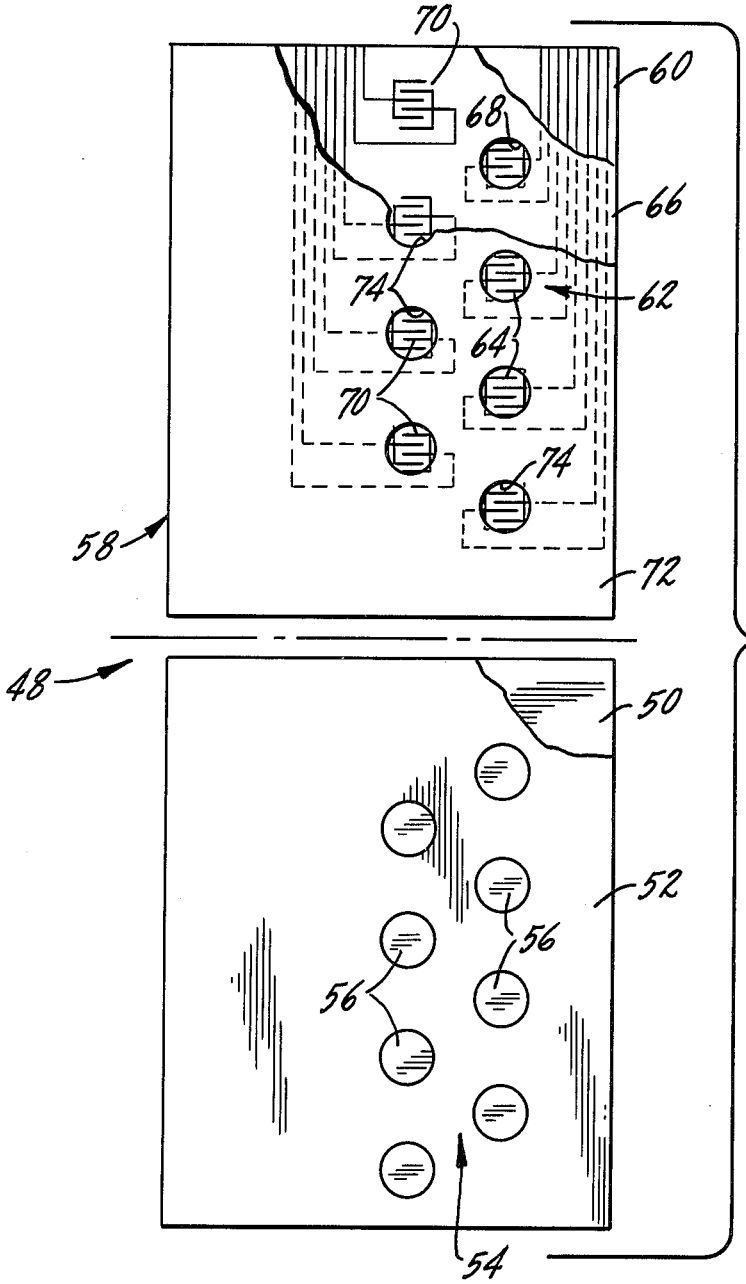
Fig. 3.
Fig. 4.
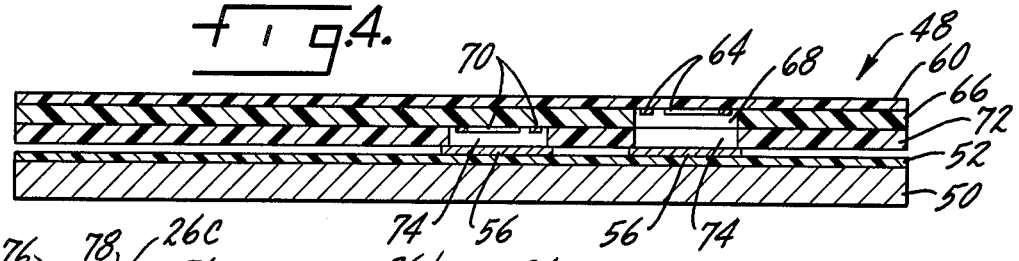
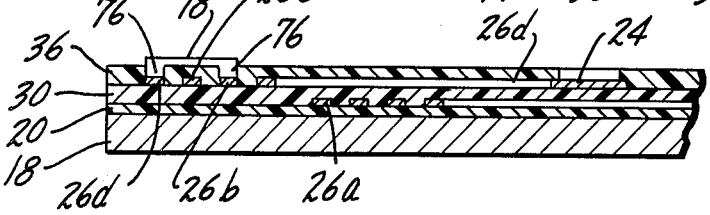
Fig. 5.

MEMBRANE SWITCH CONSTRUCTION AND METHOD FOR MAKING SAME

SUMMARY OF THE INVENTION

The present invention relates to membrane switches and in particular to a structure which provides a very dense switch pattern and can be conveniently adapted for interconnections and crossovers. The invention is particularly adapted for use in a membrane switch keyboard.

An object of the present invention is the inexpensive manufacture of a membrane switch on a keyboard.

Another object of the present invention is a membrane switch of the type described which is formed using only a single layer of flexible sheet material.

Another object is a membrane switch capable of providing a very dense switch pattern.

Another object is a membrane switch capable of providing an interconnector pattern which requires no drilled holes.

Another object is a membrane switch of the type described which while having a rigid base suitable for use in a full-stroke or full travel keyboard, allows printing of the major circuit elements on the flexible membrane.

BRIEF DESCRIPTION OF THE DRAWINGS

FIG. 3 is a view similar to FIG. 1, showing an alternate configuration of the switch.

FIG. 4 is a sectional elevation view of the composite switch of FIG. 3, showing the relation of the various parts.

FIG. 5 is a section taken generally along line 5—5 of FIG. 1.

DESCRIPTION OF A PREFERRED EMBODIMENT

With the introduction of micro-processors and other sophisticated, relatively inexpensive electronics, switching functions can now be reduced to the opening and closing of contacts permitting a simplified and more reliable switch construction. The membrane switch disclosed herein is specifically directed to this concept wherein there is only an opening and closure of a switch contact with more sophisticated switching functions being carried on by the auxiliary electronics.

Prior membrane switches typically are made in a three-piece construction. A substrate has stationary conductors formed on it. A flexible membrane also has conductors formed thereon. The membrane overlies the substrate with a spacer interposed therebetween. The spacer normally holds the conductors on the membrane in spaced, non-contacting relation with those on the substrate. Pressure on the exterior of the membrane causes the conductors to move through the holes in the spacer to contact the conductors on the substrate, thus closing the switch. Prior switches usually used layers of polyester, such as Mylar, on the order of 0.005 inches thick for the membrane and substrate. The spacer would also be made of similar material. When this type of switch is adapted for use in a full travel keyboard, it is necessary to provide a rigid base for absorbing the impact of the actuating keys.

The present invention is directed in part toward a more economical membrane switch for use on a keyboard. Specifically, the switch of this invention eliminates the need for a plastic substrate and a separate rigid mounting surface.

Figure 1:
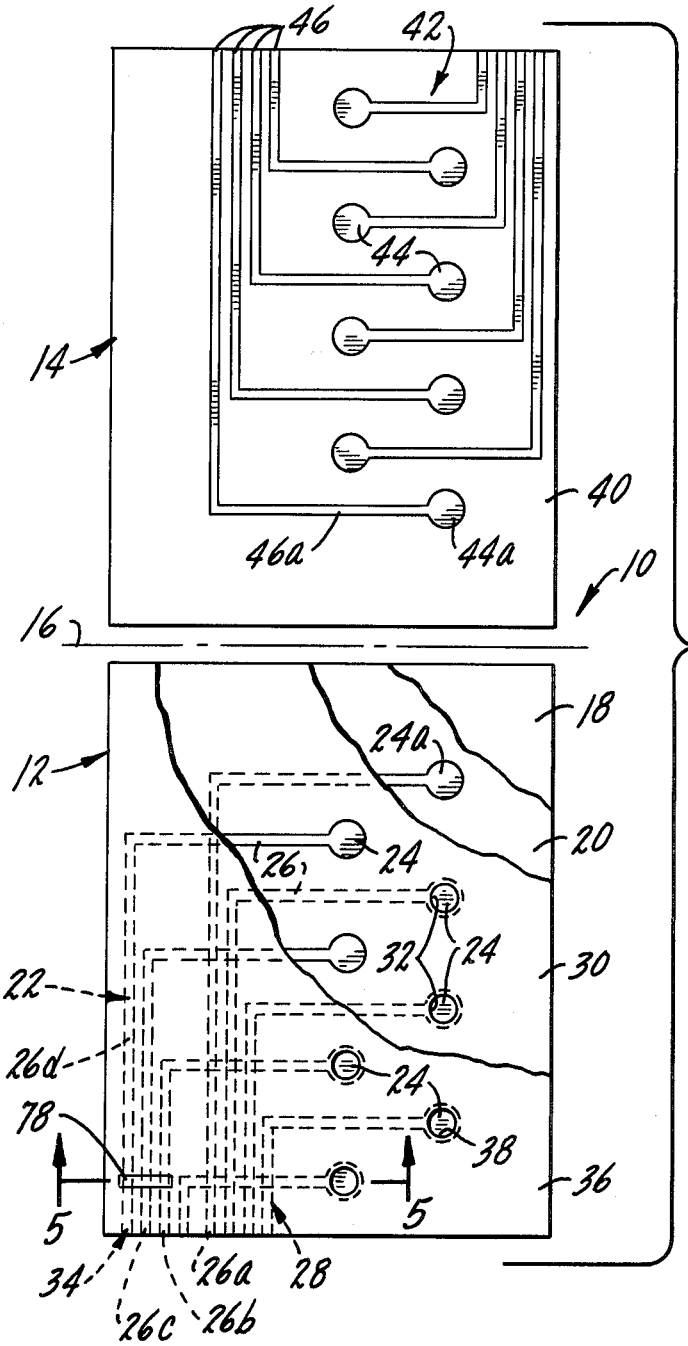
FIG. 1 is an opened plan view of a membrane switch with portions broken away and the top membrane portion rotated about a horizontal axis so the view shows the underside of the membrane.
Figure 2:
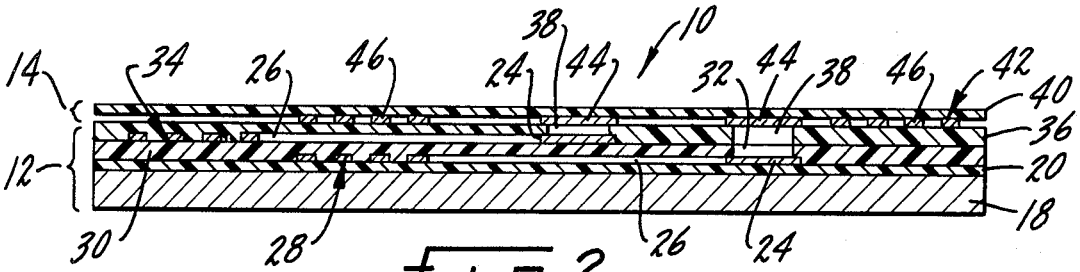
FIG. 2 is a sectional elevation view of the composite switch of FIG. 1, showing the relation of the various parts.

Turning now to the drawings, FIGS. 1 and 2 illustrate a keyboard constructed in accordance with this invention. For purposes of description, the membrane switch 10 has been divided and opened up in FIG. 1 into a bottom portion 12 and a top portion 14. The composite switch is formed by folding the portion 14 about the line 16 onto the bottom portion 12.

The switch has a substrate which includes a rigid plate or base 18. The plate may be a dielectric or it could be aluminum or steel of suitable thickness, typically on the order of 0.060 inches. In the latter case, the plate 18 is coated, sprayed or silk screened with a cover layer 20 of insulative material applied in liquid form. For example, an ultra-violet curable paint may be used for the cover layer 20. A first set of electrical conductors designated generally at 22, is formed on the cover layer 20. The conductors 22 comprise a plurality of switch sites 24 with connecting leads 26. The leads may extend to a suitable tail (not shown) for connection to auxiliary electronics.

The conductors 22 are preferably applied in liquid form by a silk screening process. Alternately, the conductors could be painted or sprayed onto the cover layer. Of course, the conductors are cured or allowed to dry before subsequent parts of the switch are added.

It can be seen that the density of switch sites is somewhat limited by the space available for the leads 26. In general, the leads must be isolated from one another to prevent generating erroneous switch signals. The present invention allows a very dense pattern of switch sites by arranging the first set of conductors 22 in two tiers. A lower tier 28 is formed directly on top of the cover layer 20. An isolation layer 30 of insulative material covers the lower tier 28. The isolation layer 30 has holes as at 32 which are in register with the switch sites of the lower tier conductors 28. These holes 32 provide access to the switch sites of the lower tier. An upper tier of conductors is shown generally at 34. The upper tier 34 lies on top of the isolation layer 30, vertically separated from the lower tier. The switch sites of the upper tier are horizontally spaced from those of the lower tier. That is, no two switch sites of the upper and lower tiers lie directly atop one another. It can be seen that the two-tiered configuration allows the switch sites to be close together without creating interference among the various leads 26.

A non-conductive spacing means 36 is formed on top of the first set of conductors. The spacing means 36 has holes 38 in register with the switch sites 24 of both tiers of conductors. Thus access to the upper tier is provided through a hole 38 in the spacer and access to the lower tier switch sites is provided through holes 38 in the spacer and holes 32 in the isolation layer 30. The spacing means could be a discreet layer of plastic material with holes punched therein. Or it could be applied in liquid form by a process such as silk screening with the holes being formed at the appropriate locations during the screening process. A further alternate is the universal spacer configuration disclosed and claimed in the copending application Ser. No. 138,656, filed Apr. 9, 1980, assigned to the present assignee. Moreover, the spacer could be applied to the upper portion 14 rather than to the lower portion 12 as shown. It is not critical where the spacer is actually applied so long as it ends up between the upper and lower portions.

A flexible membrane 40 is the top layer in the composite switch. The membrane has a second set of electrical conductors 42 formed thereon, preferably by silk screening. The second set of conductors includes a plurality of switch sites 44. When the switch is completed the sites 44 will be aligned with corresponding sites 24 in the first set of conductors 22. The second set of conductors 42 also includes leads 46 which extend from the switch sites 44 to a suitable tail (not shown) for connection to auxiliary electronics. The membrane may have indicia for assisting a user of the switch.

The switch sites shown in FIG. 1 are in the form of contact pads. It will be understood that other forms, including interdigitated fingers of separate electrodes with facing shorting bars, could be used. The reference to first and second conductors includes any of the various, well-known forms of conductors. Also the particular number and arrangement of switch sites and leads is intended for illustrative purposes only.

The construction of the switch lends itself to a manufacturing process wherein the portions of the switch are made by a sequence of silk screening operations. First the plate 18 is formed. Then cover layer 20 is applied and dried. Next the first set of conductors 22 is applied by first forming the lower tier 28, then the isolation layer 30 with holes 32, and finally the upper tier 34. Of course each layer must be dried or cured before the succeeding layer can be added. In the illustrated embodiment the spacer 36 is placed on top of the first set of conductors. The membrane 40 and its conductors 42 may be separately prepared. The composite switch is made by assembling the membrane on top of the lower portion of the switch.

The operation of the switch is as follows. In the conductor configuration shown, one of the sets of conductors serves as the input or "hot" side of the switch and the other set serves as the output. For example, a signal may exist on lead 26*a* (FIG. 1) and its associated switch site 24*a*. To close that switch, the user presses on the membrane at the location of the switch site 44*a*. Pressure may be applied by the user's finger or some other mechanical actuator. The contact pad will deflect through the spacer 36 and, in this instance, through the isolation layer 30. Contact between the pads closes the switch and provides an output signal on lead 46*a*.

FIGS. 3 and 4 show an alternate configuration of the present invention. In this embodiment, the two-tiered set of conductors is formed on the plastic membrane. The lower portion of the switch 48 has a rigid plate 50 which is coated, sprayed or silk screened with an insulative material to form a cover layer 52. A first set of conductors 54 takes the form of a plurality of switch sites which are shorting pads or bars 56.

The remaining parts of the switch are formed on the upper portion 58. This portion includes a flexible membrane 60 which has a second set of conductors 62 arranged thereon. As in the embodiment of FIG. 1, a denser pattern of switch sites can be obtained by arranging the second set of conductors in two tiers. The upper tier conductors 64 are located directly on the underside of the membrane 60. An isolation layer 66 of insulative material is applied over the upper tier 64. The isolation layer 66 has holes 68 to provide access to the switch sites of the upper tier conductors. Lower tier conductors 70 lie on the isolation layer 66. It will be noted that the second conductor's switch sites have an interdigitated pattern of spaced electrodes. The electrodes have separate leads which may extend to a suitable tail. When the switch is actuated the interdigitated fingers of the electrodes contact the shorting pads 56 thereby connecting the separate electrodes and closing the switch. However, as pointed out above, the first and second conductors could have other forms than that shown.

A spacing means 72 is placed on the upper portion 58. It has holes 74 which line up with the shorting pads 56 to provide access to the switch sites.

The embodiment of FIGS. 3 and 4 can be made by a sequence of silk screening steps similar to that described above. The advantage of this embodiment is most of the silk screening operations are performed on the plastic membrane. This allows printing on a roll-to-roll basis. This is a significant advantage because from a material handling standpoint, it is much easier to work with the plastic membrane material than with the relatively rigid plate material.

FIG. 5 illustrates a further aspect the present invention. A commonly encountered problem in printed circuits is the need to connect two leads which are separated by an intervening obstruction. Quite often the obstruction is a third lead. This problem is commonly solved by using doubled-sided, plated-through circuit boards. This is an expensive approach because holes have to be drilled in the circuit board and the holes must be plated through to the conductors on both sides of the board. The present invention solves the problem with a crossover which utilizes the spacing means as a crossover insulator.

FIG. 1 illustrates the situation where a crossover conductor is needed. Suppose it is desired to connect leads 26*b* and 26*d* without encircling the obstruction provided by lead 26*c*. FIG. 5 illustrates how this can be done without the use of plated-through holes. Leads 26*b*, 26*c* and 26*d* are on the upper tier of conductors, that is, they rest on the isolation layer 30. The spacing means 36 covers the leads. However, where a crossover is desired an interconnect hole 76 is formed in the spacer in register with the leads to which interconnection is to be made. Then, after the spacer is applied, a crossover electrode 78 is applied at the location of the interconnect holes 76. If the conductors are applied in liquid form, the liquid will flow into the interconnect hole and electrically bond to the lower tier conductor. This provides a convenient way to interconnect the various switch leads, if that is desired. The crossover construction does not at all depend on the existence of switches. The disclosed crossover could be used on any printed circuit where a spacer is used. Also, the spacing means need not cover the entire area. It could be a series of locally formed spots of insulator material which supports a crossover conductor. For example, the universal spacer referred to above could be used. Obviously, with such a spacer, the crossover location would be carefully controlled to avoid unwanted short circuits.

Whereas the preferred form of the invention has been shown and described herein, it should be realized that there may be many modifications, substitutions and alterations thereto.

We claim:

1. A membrane switch, comprising:

a substrate;

a first set of electrical conductors applied to the substrate and including at least an upper and lower tier of conductors, each tier having a plurality of switch sites, the tiers being separated by an isolation layer of insulative material, the isolation layer having holes in register with the lower tier switch sites to permit access thereto;

a single flexible membrane having a second set of electrical conductors formed thereon including a plurality of switch sites in facing relation with the switch sites of the first set of conductors;

a non-conductive spacing means disposed between the first and second conductors, said spacing means having holes in register with the switch sites such that the conductors can contact each other in response to pressure on the exterior of said membrane, the spacing means otherwise maintaining the conductors in spaced, non-contacting relation.

2. The structure of claim 1 wherein the spacing means has interconnect holes in register with selected conductors and at least one crossover conductor is applied to the spacing means on the side opposite the selected conductors, the crossover conductor electrically connecting said selected conductors at the interconnect holes.

3. The structure of claim 1 wherein the isolation layer is applied in liquid form which is then dried.

4. The structure of claim 1 wherein the substrate comprises a substantially rigid plate which is covered with a layer of insulative material applied in liquid form to the plate.

5. The structure of claim 1 wherein the first conductor switch sites include a pair of spaced electrodes having interdigitated fingers and the second conductor switch sites comprise a shorting bar which connects said electrodes when the switch is actuated.

6. A membrane switch, comprising:

a substrate;

a first set of electrical conductors applied to the substrate and forming a plurality of switch sites;

a single flexible membrane having a second set of electrical conductors formed thereon including at least an upper and lower tier of conductors, each tier having a plurality of switch sites, the tiers being separated by an isolation layer of insulative material, the isolation layer having holes in register with the upper tier switch sites to permit access thereto, the switch sites of the second set of conductors being in facing relation with the switch sites of the first set of conductors;

a non-conductive spacing means disposed between the first and second conductors, said spacing means having holes in register with the switch sites such that the conductors can contact each other in response to pressure on the exterior of said membrane, the spacing means otherwise maintaining the conductors in spaced, non-contacting relation.

7. The structure of claim 6 wherein the spacing means has interconnect holes in register with selected conductors and at least one crossover conductor is applied to the spacing means on the side opposite the selected conductors, the crossover conductor electrically connecting said selected conductors at the interconnect holes.

8. The structure of claim 6 wherein the isolation layer is applied in liquid form which is then dried.

9. The structure of claim 6 wherein the substrate comprises a substantially rigid plate which is covered with a layer of insulative material applied in liquid form to the plate.

10. The structure of claim 6 wherein the second conductor switch sites include a pair of spaced electrodes having interdigitated fingers and the first conductor switch sites comprise a shorting bar which connect said electrodes when the switch is actuated.

11. The method of manufacturing a membrane switch, comprising the steps of:

(a) forming a substrate;

(b) applying a lower tier of conductors including switch sites to the substrate;

(c) applying an isolation layer in liquid form over the lower tier of conductors, said isolation layer have holes at the switch sites to provide access thereto;

(d) drying the isolation layer;

(e) applying an upper tier of conductors, including switch sites on the isolation layer;

(f) preparing a spacing means having holes in register with the switch sites;

(g) preparing a flexible membrane and forming a set of conductors thereon including a plurality of switch sites in facing relation with the switch sites of the upper and lower tiers; and (h) assembling said substrate, spacing means and membrane in composite form to complete the keyboard.

12. The method of claim 11 wherein the conductors are applied in liquid form which is then dried.

13. The method of claim 11 wherein the spacing means is applied in liquid form which is then dried.

14. The method of claim 11 wherein the substrate is substantially rigid.

15. The method of manufacturing a membrane switch, comprising the steps of:

(a) forming a substrate;

(b) applying a first set of conductors to the substrate, said conductors including a plurality of switch sites;

(c) preparing a spacing means having holes in register with the switch sites of the first set of conductors;

(d) preparing a flexible membrane;

(e) applying an upper tier of conductors including switch sites to the underside of the membrane;

(f) applying an isolation layer in liquid form over the upper tier of conductors, said isolation layer having holes at the switch sites to provide access thereto;

(g) drying the isolation layer;

(h) applying a lower tier of conductors, including switch sites to the isolation layer, the switch sites of both the upper and lower tiers being in register with the holes of the spacing means;

(i) assembling said substrate, spacing means and membrane in composite form to complete the keyboard.

16. The method of claim 15 wherein the conductors are applied in liquid form which is then dried.

17. The method of claim 15 wherein the spacing means is applied in liquid form which is then dried.

18. The method of claim 15 wherein the substrate is substantially rigid.

19. In a membrane switch, a substrate, a first set of electrical conductors on the substrate having a plurality of switch sites, a flexible membrane having a second set of electrical conductors formed thereon including a plurality of switch sites in facing relation with the switch sites of the first set of conductors, a non-conductive spacing means disposed between the first and second conductors, said spacing means having holes in register with the switch sites and interconnect holes in register with selected conductors, and at least one crossover conductor applied to the spacer such that it electrically connects said selected conductors at the interconnect holes.

20. A membrane switch, comprising:

a substantially rigid plate;

a cover layer of insulative material applied in liquid form to the plate;

a first set of electrical conductors applied to the cover layer and forming a plurality of switch sites, the first set of conductors having at least an upper and lower tier of conductors, each tier having a plurality of switch sites, the tiers being separated by an isolation layer of insulative material which is applied in liquid form, the isolation layer having holes in register with the lower tier switch sites to permit access thereto;

a flexible membrane having a second set of electrical conductors formed thereon including a plurality of switch sites in facing relation with the switch sites of the first set of conductors;

a non-conductive spacing means disposed between the first and second conductors, said spacing means having holes in register with the switch sites such that the conductors can contact each other in response to pressure on the exterior of said membrane, the spacing means otherwise maintaining the conductors in spaced, non-contacting relation; and at least one crossover conductor lying on the spacing means, the spacing means having interconnect holes at selected points which permit the crossover conductor to electrically connect selected upper tier conductors.

21. The structure of claim 20 wherein the crossover conductor is applied in liquid form and, when applied, fills the interconnect holes to effect the electrical connection, the conductors then being dried.

22. A membrane switch, comprising:

a substantially rigid plate;

a cover layer of insulative material applied in liquid form to the plate;

a first set of electrical conductors applied to the cover layer and forming a plurality of switch sites;

a flexible membrane having a second set of electrical conductors formed thereon including a plurality of switch sites in facing relation with the switch sites of the first set of conductors, said second set of conductors comprising at least an upper and lower tier of conductors, each tier having a plurality of switch sites, the tiers being separated by an isolation layer of insulative material which is applied in liquid form, the isolation layer having holes in register with the upper tier switch sites to permit access thereto by the first set of conductors;

a non-conductive spacing means disposed between the first and second conductors, said spacing means having holes in register with the switch sites such that the conductors can contact each other in response to pressure on the exterior of said membrane, the spacing means otherwise maintaining the conductors in spaced, non-contacting relation; and at least one crossover conductor lying under the spacing means, the spacing means having interconnect holes at selected points which permit the crossover conductor to electrically connect selected lower tier conductors.

23. The structure of claim 22 wherein the crossover conductor is applied in liquid form and, when applied, fills the interconnect holes to effect the electrical connection, the conductors then being dried.

24. In a membrane switch keyboard of the type having a substrate, a first set of conductors on the substrate and having a plurality of switch sites, a flexible membrane, a second set of conductors on the underside of the membrane and having a plurality of switch sites in facing relation with the switch sites of the first set of conductors, a non-conductive spacing means disposed between the first and second conductors, said spacing means having holes in register with the switch sites such that the conductors can contact each other in response to pressure on the exterior of said membrane, the spacing means otherwise maintaining the conductors in spaced, non-contacting relation, an improved method of manufacturing the keyboard, comprising the step of:

(a) forming a plate of substantially rigid material;

(b) applying a cover layer of insulative material in liquid form to said plate and then drying the cover layer;

(c) applying said first set of conductors to said cover layer;

(d) preparing said spacing means;

(e) preparing a flexible membrane and forming said second set of conductors thereon; and (f) assembling said plate, spacing means and membrane in composite form to complete the keyboard.

25. The method of claim 24 wherein the first and second set of conductors are applied in liquid form which is then dried.

26. The method of claim 24 wherein the spacing means is applied to one of the sets of conductors in liquid form which is then dried.

27. The method of claim 24 wherein the spacing means is formed with interconnect holes in register with selected conductors and at least one crossover conductor is applied to the spacer such that it electrically connects said selected conductors at the interconnect holes.

28. The method of claim 24 wherein the step of applying the first set of conductors further includes the steps of:

(a) applying a lower tier of conductors including switch sites;

(b) applying an isolation layer in liquid form over the lower tier of conductors, said isolation layer having holes at the switch sites to provide access thereto;

(c) drying the isolation layer;

(d) applying an upper tier of conductors, including switch sites, on the isolation layer.

29. The method of claim 24 wherein the step of forming the second set of conductors further includes the steps of:

(a) applying an upper tier of conductors including switch sites to the membrane;

(b) applying an isolation layer in liquid form over the upper tier of conductors, said isolation layer having holes at the switch sites, to provide access thereto;

(c) drying the isolation layer;

(d) applying a lower tier of conductors, including switch sites, to the isolation layer.

* * * * *